US005937237A

United States Patent [19]

Nonaka et al.

[11] Patent Number: 5,937,237

[45] Date of Patent: Aug. 10, 1999

[54] SEAL MEMBER, TONER CONTAINER AND PROCESS CARTRIDGE

[75] Inventors: Fumito Nonaka, Abiko; Shinichi Sasaki, Shizuoka-ken; Isao Ikemoto, Kashiwa; Yoshiyuki Batori, Toride, all of Japan

[73] Assignee: Canon Kabushiki Kaisha, Tokyo, Japan

[21] Appl. No.: 08/900,400

[22] Filed: Jul. 21, 1997

[30] Foreign Application Priority Data

Jul. 24, 1996 [JP] Japan ..... 8-213007

[51] Int. Cl.[6] ..... G03G 15/00

[52] U.S. Cl. ..... 399/106; 399/111; 399/262

[58] Field of Search ..... 399/106, 111, 399/262, 263

[56] References Cited

U.S. PATENT DOCUMENTS

| | | | |
|---|---|---|---|
| 4,732,277 | 3/1988 | Smith | 206/633 |
| 4,981,218 | 1/1991 | Ban et al. | 229/123.1 |
| 5,134,441 | 7/1992 | Nagata et al. | 355/245 |
| 5,153,650 | 10/1992 | Maeshima | 399/106 |
| 5,345,294 | 9/1994 | Nomura et al. | 355/200 |
| 5,475,470 | 12/1995 | Sasago et al. | 355/210 |
| 5,500,714 | 3/1996 | Yashiro et al. | 355/200 |
| 5,513,679 | 5/1996 | Yamada | 141/364 |
| 5,585,902 | 12/1996 | Nishiuwatoko et al. | 355/260 |
| 5,623,328 | 4/1997 | Tsuda et al. | 399/111 |

FOREIGN PATENT DOCUMENTS

| | | |
|---|---|---|
| 0586041 | 3/1994 | European Pat. Off. . |
| 0661608 | 7/1995 | European Pat. Off. . |
| 0679963 | 11/1995 | European Pat. Off. . |
| 0692747 | 1/1996 | European Pat. Off. . |
| 2-28530 | 7/1990 | Japan . |

*Primary Examiner*—Joan Pendegrass
*Attorney, Agent, or Firm*—Fitzpatrick, Cella, Harper & Scinto

[57] ABSTRACT

The present invention provides a seal for openably closing a toner supply opening of a toner container containing toner used in an image forming apparatus, the seal member comprising a seal portion for openably closing the toner supply opening, a grip provided at one end of the seal portion and adapted to be gripped when the toner supply opening is unsealed, the grip having a hole, and an attachment portion for detachably attaching the grip to a frame of the toner container.

62 Claims, 13 Drawing Sheets

SEAL MEMBER, TONER CONTAINER AND PROCESS CARTRIDGE

BACKGROUND OF THE INVENTION

1. Field of the Invention

The present invention relates to a seal member, a toner container, and a process cartridge used in an electrophotographic image forming apparatus. The term electrophotographic image forming apparatus" refers to is an image forming apparatus for forming an image on a recording medium by using an electrophotographic image forming system and may include, for example, in an electrophotographic copying machine, an electrophotographic printer (such as a laser beam printer, an LED printer, and the like), an electrophotographic facsimile, and an electrophotographic word processor.

The "process cartridge" may incorporate therein an electrophotographic photosensitive member, a charge means, a developing means, or a cleaning means as a cartridge unit which can removably be mounted on an image forming apparatus. The process cartridge may also incorporate an electrophotographic photosensitive member, and at least one of a charge means, a developing means, and a cleaning means as a cartridge unit which can removably be mounted on an image forming apparatus. The process cartridge may also incorporate therein an electrophotographic photosensitive member and at least a developing means as a cartridge unit which can removably be mounted on an image forming apparatus.

2. Related Background Art

In conventional developing units or process cartridges, an opening portion of a toner container containing toner therein is closed or sealed prior to use by a seal member, thereby preventing communication between the toner container and a developing chamber. In use, an operator peels the seal member to unseal the toner container. The peeling of the seal member is performed by an operator pulling a grip secured to one end of the seal member.

An unsealing technique for unsealing the toner container is disclosed in the Japanese Utility Model Publication No. 2-28530, for example. In this arrangement, a grip member for peeling a seal member from a toner container is removably inserted into a support portion of the toner container.

With this arrangement, since the grip portion is not suspended, an excellent effect can be achieved.

SUMMARY OF THE INVENTION

An object of the present invention is to provide a seal member, a toner container, and a process cartridge in which operability is improved.

Another object of the present invention is to provide a seal member, a toner container using such a seal member, and a process cartridge using such a seal member in which, when the seal member is pulled, an operator's fingers fit through the seal member.

A further object of the present invention is to provide a seal member, a toner container using such a seal member, and a process cartridge using such a seal member in which a grip portion has a hole.

A still further object of the present invention is to provide a seal member, a toner container using such a seal member, and a process cartridge using such a seal member, which include a seal portion for openably sealing a toner supply opening, a grip portion provided at one end of the seal portion and having a hole to be gripped upon unsealing, and an attachment portion for detachably attaching the grip portion to a frame of the toner container.

DETAILED DESCRIPTION OF THE PREFERRED EMBODIMENTS

Embodiments of the present invention will be explained with reference to the accompanying drawings.

(First Embodiment)

A process cartridge and an image forming apparatus to which the process cartridge can be mounted will be described with reference to FIGS. 1 to 4. FIGS. 13 to 16 are perspective views showing a developing unit of the process cartridge, and frames constituting the developing unit. FIGS. 5 to 12 are explanatory views showing toner seal grips of a process cartridge mounting means.

First of all, the entire construction of the process cartridge and the image forming apparatus using such a process cartridge will be described, and then the construction of a developer (referred to also as "toner" hereinafter) sealing seal member and an unsealing grip will be described.

[Entire Construction]

Figure 3:
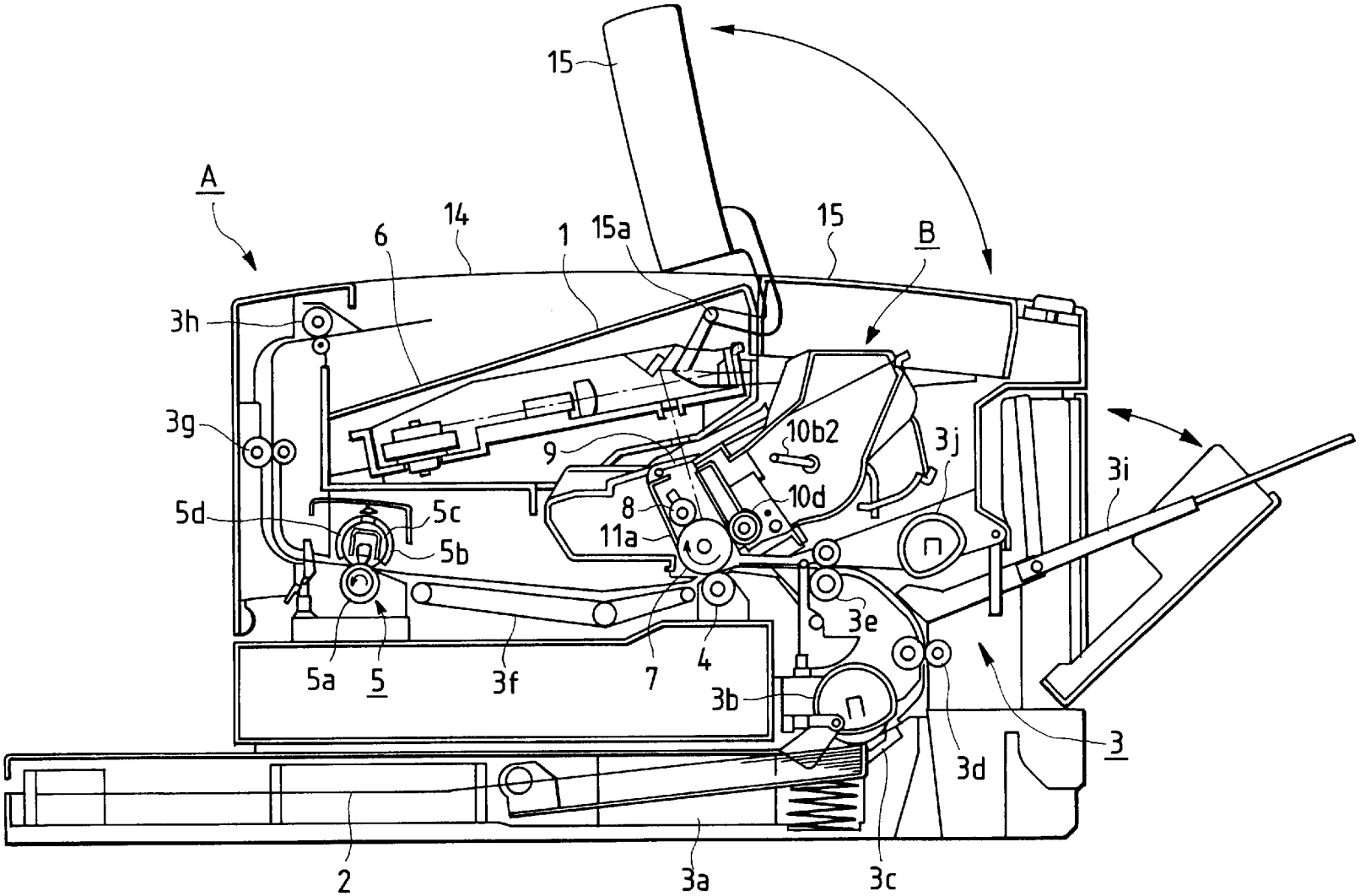
FIG. 3 is an elevational sectional view of an image forming apparatus.

As shown in FIG. 3, in an electrophotographic image forming apparatus (laser beam printer) A, a latent image is formed on a photosensitive drum (drum-shaped electrophotographic photosensitive member) 7 by projecting information light from an optical system 1 onto the photosensitive drum 7 in response to image information, and the latent image is developed with toner as a toner image. In synchronism with the formation of the toner image, recording media 2 are supplied, one-by-one, from a sheet supply cassette 3*a,* (containing the recording media), a pick-up roller 3*b,* and a press member 3*c* urged against the pickup roller, and the separated recording medium 2 is conveyed by a convey means 3 comprised of a pair of convey rollers 3*d* and a pair of regist rollers 3*e.* The toner image formed on the photosensitive drum 7 of the process cartridge B is transferred onto the recording medium 2 by applying voltage to a transfer roller (transfer means) 4. Then, the recording medium 2 is conveyed to a fixing means 5 through a convey belt 3*f.*

The fixing means 5 comprises a drive roller 5*a,* and a ring-shaped fixing rotary member 5*d* including a heater 5*b* therein and rotatably supported by a support 5*c.* While the recording medium 2 is passed through the fixing means, the toner image (transferred to the recording medium) is fixed to the recording medium by applying heat and pressure to the recording medium. Thereafter, the recording medium 2 is discharged onto a discharge portion 6 through a reverse rotation convey path by pairs of discharge rollers 3*g,* 3*h.* Incidentally, the image forming apparatus A permits manual sheet insertion through a manual insertion tray 3*i* and a roller 3*j.*

(Process Cartridge)

Figure 4:
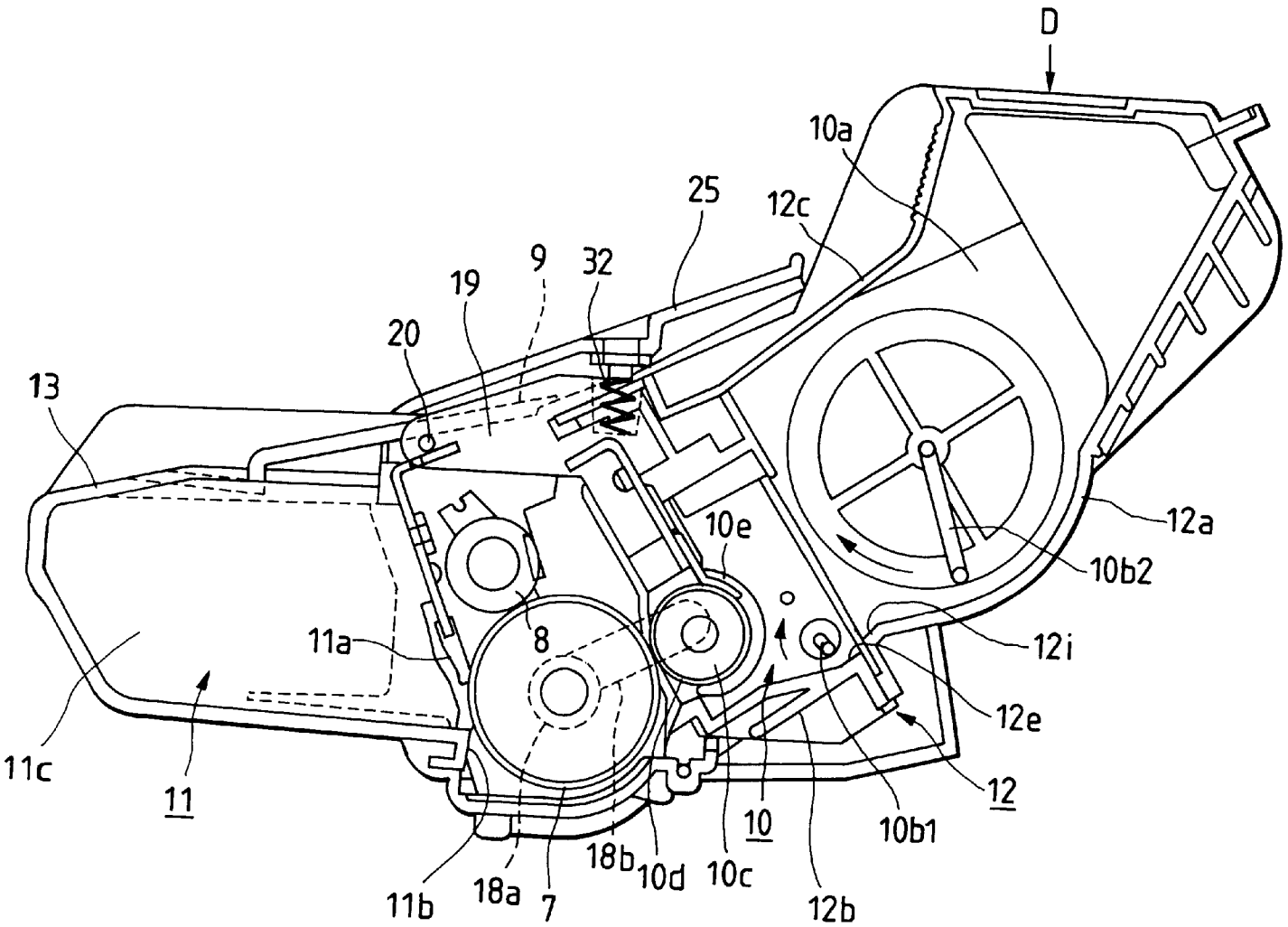
FIG. 4 is a sectional view of the process cartridge.

The process cartridge B includes the electrophotographic photosensitive member (photosensitive drum) and at least one process means. The process means may include a charge means for charging the electrophotographic photosensitive member, a developing means for developing the latent image formed on the electrophotographic photosensitive member and/or a cleaning means for cleaning residual toner remaining on the electrophotographic photosensitive member. In the process cartridge B according to the illustrated embodiment, as shown in FIG. 4, the photosensitive drum (electrophotographic photosensitive member) 7 having a photosensitive layer is rotated, a surface of the photosensitive drum 7 is uniformly charged by applying voltage to a charge roller (charge means) 8, a latent image is formed by projecting a light image onto the charged photosensitive drum 7 from the;optical system 1 through an exposure opening 9 and the latent image is developed by a developing means 10.

In the developing means 10, toner contained in a toner container 10*a* is fed, by a rotatable toner feed member (toner feed means) 10*b*2 disposed in the toner container. into a developing frame 12*b* through an opening portion 12*i* of a toner frame 12*a* including the toner container 10*a* and an opening portion 12*e* of the developing frame 12*b,* to agitate the toner by a toner agitating member 10*b*1. A developing roller (developing rotary member) 10*d* including a fixed magnet 10*c* therein is rotated to form a toner layer formed on a surface thereof while applying frictional charges to the toner by a developing blade 10*e.* The toner is transferred from the toner layer onto the latent image on the photosensitive drum 7, thereby visualizing the latent image as the toner image.

After the toner image is transferred to the recording medium 2 by applying voltage having a polarity opposite to that of the toner image to the transfer roller 4, residual toner remaining on the photosensitive drum 7 is scraped from the photosensitive drum by a cleaning blade 11*a* received by a dip sheet 11*b* to be collected into a waste toner container 11*c.* The cleaning blade, dip sheet and waste toner container constitute a cleaning means 11 for removing the residual toner remaining on the photosensitive drum 7.

Incidentally, various members such as the photosensitive drum 7 are included in a cartridge frame obtained by joining a developing unit D (obtained by welding the toner frame 12*a* (including the toner container 10*a* and rotatably supporting the toner feed member 10*b*2), the developing frame 12*b* (including developing members such as the toner agitating member 10*b*1, the developing roller and the like) and a lid member 12*c* together), and a cleaning frame 13 including the waste toner container 11*c,* the photosensitive drum 7, the cleaning blade 11*a* and the dip sheet 11*b,* and the cartridge frame can be detachably mounted on a cartridge mounting means of a body 14 of the image forming apparatus. In the cartridge mounting means, when an opening/closing member 15 is opened around a shaft 15*a,* a space of the cartridge mounting portion is exposed. In this space, there are provided left and right cartridge mounting guide members (not shown). Guides of the process cartridge B comprising bosses 18*a* and a ribs 18*b* are guided in the guide members when the process cartridge B is mounted on or dismounted from the body 14 of the image forming apparatus.

(Structure of Junction between Toner Frame and Developing Frame)

Figure 14:
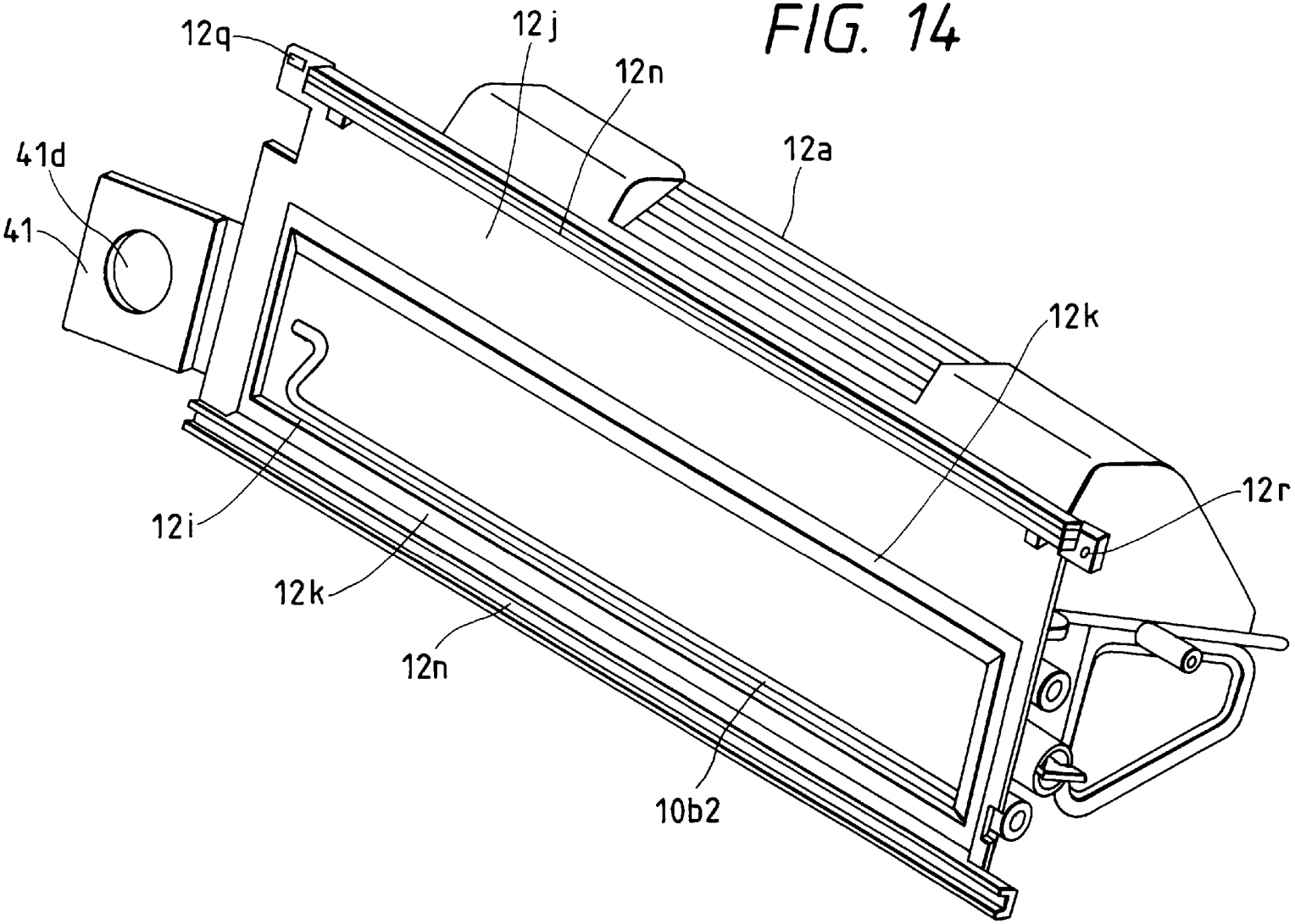
FIG. 14 is a perspective view of a toner frame.

As shown in FIGS. 4 and 14, in a junction between the toner frame 12*a* and the developing frame 12*b,* there is provided an opening portion 12*i* through which the toner is fed from the toner frame 12*a* to the developing frame 12*b.* A concave surface 12*k* is positioned around the opening portion 12*i.* Longitudinal parallel grooves 12*n* are formed in upper and lower edges of upper and lower flanges 12*j* defining the concave surface 12*k.* The "longitudinal" direction is a horizontal direction perpendicular to a recording medium conveying direction.

Figure 13:
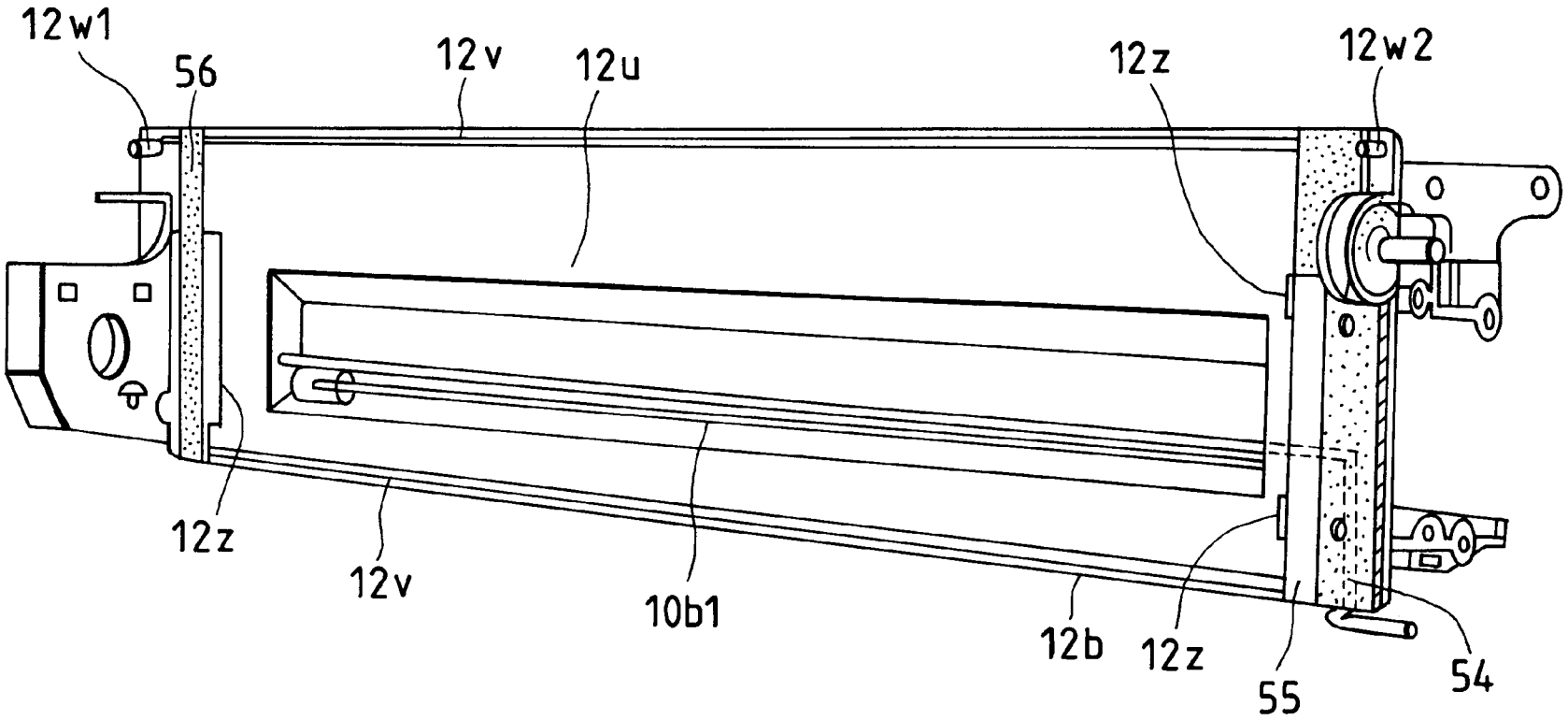
FIG. 13 is a perspective view of a developing frame.

As shown in FIG. 13, a surface of the developing frame 12*b* (which faces the toner frame 12*a*) has a flat flange 12*u,* and longitudinal ridges 12*v,* for fitting into the grooves 12*n* of the toner frame 12*a,* are positioned along edges of the flat flange 12*u.* Triangular projections (not shown) used in ultrasonic welding are formed on top surfaces of the ridges 12*v.* After various parts are assembled, the toner frame 12*a* and the developing frame 12*b* are joined to each other by fitting the ridges 12*v* of the developing frame 12*b* into the grooves 12*n* of the toner frame 12*a* and by effecting ultrasonic welding along the longitudinal direction.

Figure 15:
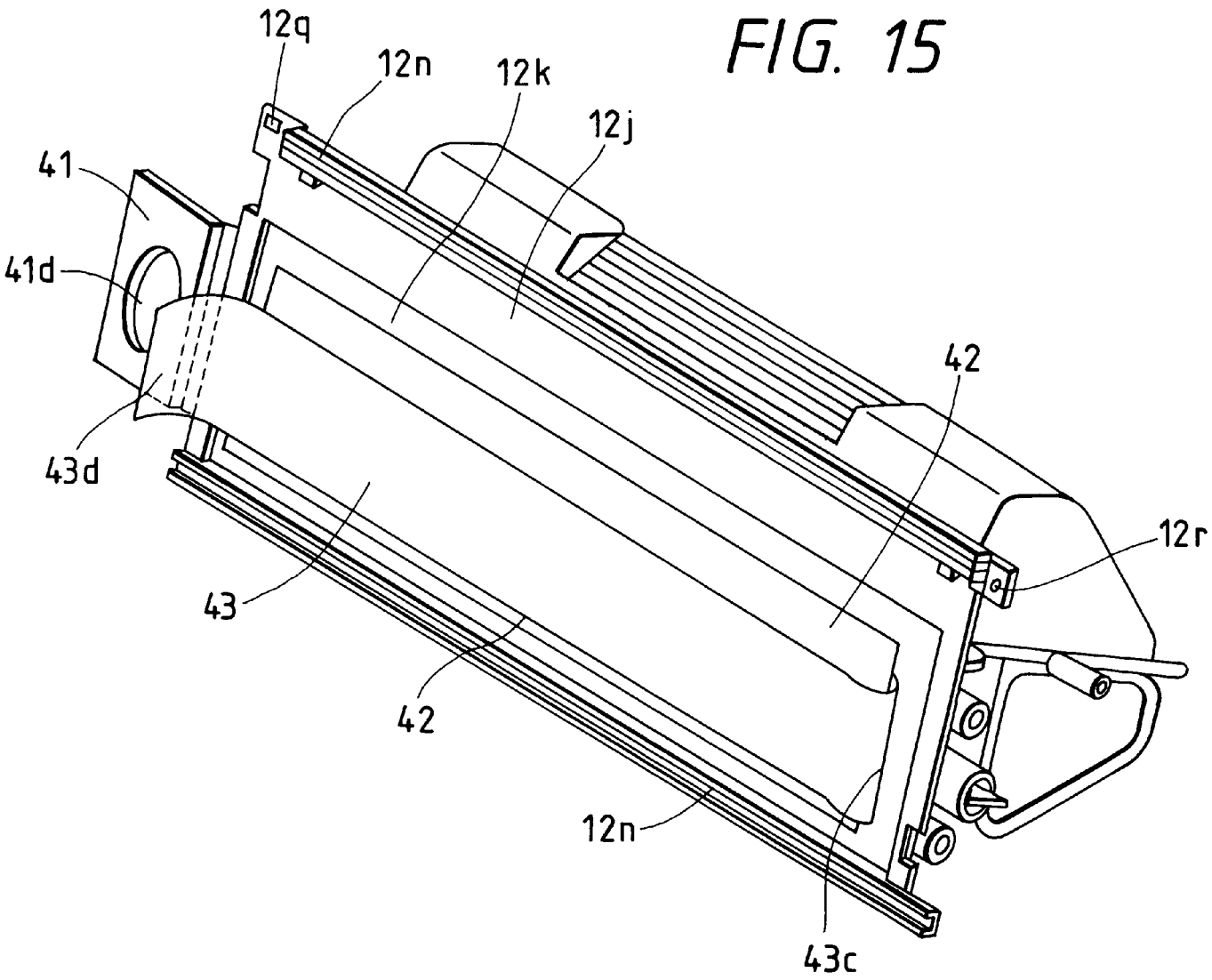
FIG. 15 is a perspective view of a toner frame, viewed from another direction.

As shown in FIG. 15, a cover film (toner seal) 42, tearable in the longitudinal direction, is adhered to the concave surface 12*k* to close or seal the opening portion 12*i* of the toner frame 12*a.* On the concave surface 12*k,* the cover film 42 is adhered to the toner frame 12*a* along four edge portions of the opening portion 12*i.* A tear tape 43, for tearing the cover film 42 to open the opening portion 12*i,* is adhered to the cover film 42. The tear tape 43 is folded back at one longitudinal end 43*c* of the opening portion 12*i* and is extended outside between the toner frame 12*a* and an elastic seal member 54 (see FIG. 13), for example made of felt and adhered to one longitudinal end portion of the surface of the developing frame 12*b* which faces the toner frame 12*a.* Further, a grip 41 (FIGS. 1, 14 and 15) is attached to an end portion 43*d* of the extended tear tape 43. The grip 41 is formed integrally with the toner frame 12*a* and a weak line is formed between the grip and the toner frame so that the grip can easily be separated from the toner frame 12*a.* A film tape 55, made of synthetic resin and having a low coefficient of friction, is adhered to a surface of the seal member 54 at its inner side. An elastic seal member 56 (FIG. 13) is adhered to the other longitudinal end remote from the seal member 54.

The elastic seal members 54, 56 are adhered to both longitudinal end portions of the flange 12*u* through the entire width thereof. The elastic seal members 54, 56 coincide with flanges 12*j* at both longitudinal ends of the concave surface 12*k* of the toner frame 12*a* and extend through the entire widths of the flanges 12*j* and overlap with the ridges 12*v*.

A circular hole 12*r* and a rectangular hole 12*q* are formed in the flange 12*j* of the toner frame 12*a*. These holes 12*r*, 12*q* serve to be fitted on a circular peg 12*w*1 and a rectangular peg 12*w*2, respectively, of the developing frame 12*b* in order to facilitate the alignment between the frames 12*a* and 12*b* when the toner frame 12*a* is joined to the developing frame 12*b*. The circular hole 12*r* is closely fitted onto the peg 12*w*1, and the rectangular hole 12*q* is fitted on the peg 12*w*2 closely in the width-wise direction and loosely in the longitudinal direction.

Before the toner frame 12*a* is joined to the developing frame 12*b*, they are assembled independently. Upon assembling, after the opening portion 12*i* of the toner frame 12*a* is closed by the toner seal (cover film 42 and tear tape 43), toner is loaded through a toner loading opening 12*d* which is then closed by a toner cap 12*f* (FIG. 1) Thereafter, the positioning circular peg 12*w*1 and rectangular peg 12*w*2 of the developing frame 12*b* are fitted into the positioning circular hole 12*r* and rectangular hole 12*q*, of the toner frame 12*a*. Further, the ridges 12*v* of the developing frame 12*b* are fitted into the grooves 12*n* of the toner frame 12*a*. When the toner frame 12*a* and the developing frame 12*b* are urged against each other, the elastic seal members 54, 56 are urged against the longitudinal end flanges 12*j* of the toner frame 12*a* to be compressed, and ridge portions (spacers) 12*z*, formed integrally with both longitudinal ends of the flat flange 12*u* of the developing frame 12*b* along the width-wise direction, approach the flanges 12*j* of the toner frame 12*a*. At one longitudinal end, the ridge portions 12*z* are spaced along the width-wise direction to permit the passing of the tear tape 43.

Figure 16:
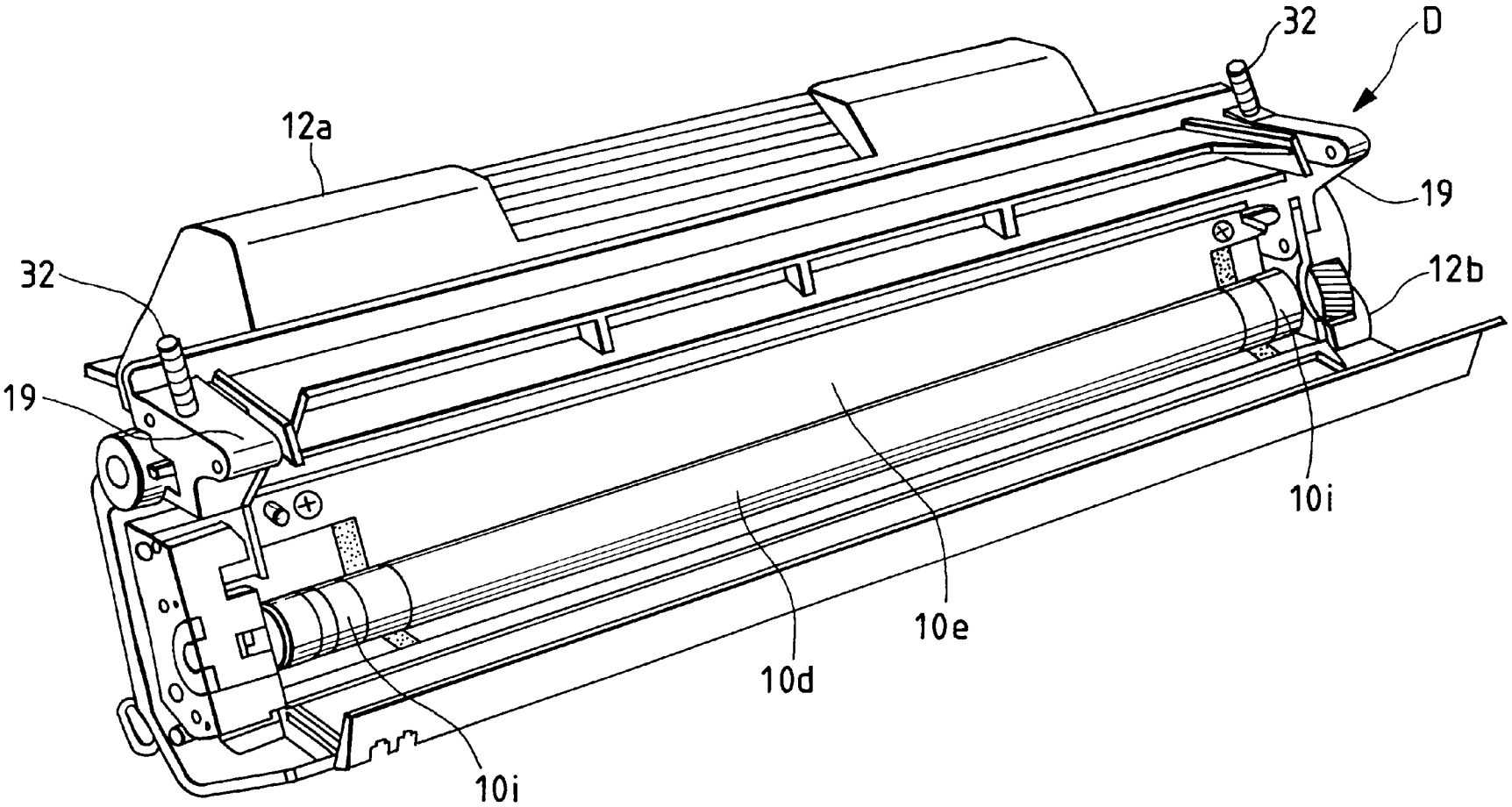
FIG. 16 is a perspective view of a developing unit.

In the above condition, ultrasonic vibration is applied between the ridges 12*v* and the grooves 12*n* while urging the toner frame 12*a* and the developing frame 12*b* against each other, so that the triangular projections formed on the ridges 12*v* are melted due to frictional heat to weld the ridges 12*v* to the bottoms of the grooves 12*n*. As a result, the edges of the grooves 12*n* of the toner frame 12*a* and the ridge portions 12*z* of the developing frame 12*b* are kept in close contact with corresponding parts, so that a space having a sealed peripheral edge, is formed between the concave surface 12*k* of the toner frame 12*a* and the opposed surface 12*u* of the developing frame 12*b*. The cover film 42 and the tear tape 43 are contained within this space. In this way, the developing unit D shown in FIG. 16 is completed.

In the illustrated embodiment, although the toner seal comprises the cover film and the tear tape, the present invention can be applied to a so-called "easy peel seal structure" in which a toner seal is constituted by folding a single sheet (film).

In the developing unit D, arm portions 19 protrude from the developing frame 12*b* toward the toner frame 12*a*. As shown in FIG. 4, free end portions of the arm portions 19 are pivotally connected to the cleaning frame 13 via pins 20. Compression coil springs 32, disposed between arm portions 25 of the cleaning frame 13 extending toward the developing unit D and the developing frame 12*b*, serve to urge the developing roller 10*d* against the photosensitive drum 7. As shown in FIG. 16, on both end portions of the developing roller 10*d* outside an image forming area, there are provided spacer rollers 10*i* each having a diameter larger than that of the developing roller 10*d*, so that the spacer rollers 10*i* contact the photosensitive drum 7 to create a gap of about 300 μm between the photosensitive drum 7 and the developing roller 10*d* at a developing area.

In order to send the toner contained in the toner frame 12*a* into the developing frame 12*b*, the grip 41 attached to the end portion 43*d* of the tear tape extending outside of the process cartridge B is separated from the toner frame 12*a*. By pulling the grip 41 by the operator, the tear tape 43 is pulled out to tear the cover film 42, so that the opening portion 12*i* of the toner frame 12*a* is opened to permit the supply of the toner from the toner frame 12*a* to the developing frame 12*b*. Since the elastic seal members 54, 56 are elastically deformed at both longitudinal ends of the flange 12*j* of the toner frame 12*a* only with its thickness reduced while keeping the parallelepipedic shape, the good sealing ability is maintained.

Since the opposed surfaces of the toner frame 12*a* and the developing frame 12*b* are so constructed, when a force for tearing the cover film 42 is applied to the tear tape 43, the tear tape 43 can be smoothly withdrawn between the frames 12*a* and 12*b*.

The toner frame 12*a* and the developing frame 12*b* may be made of plastic material such as polystyrene, ABS resin (acrylonitrile/butadiene/styrene copolymer), polycarbonate, polyethylene or polypropylene.

(Grip of Toner Seal)

Figure 5:
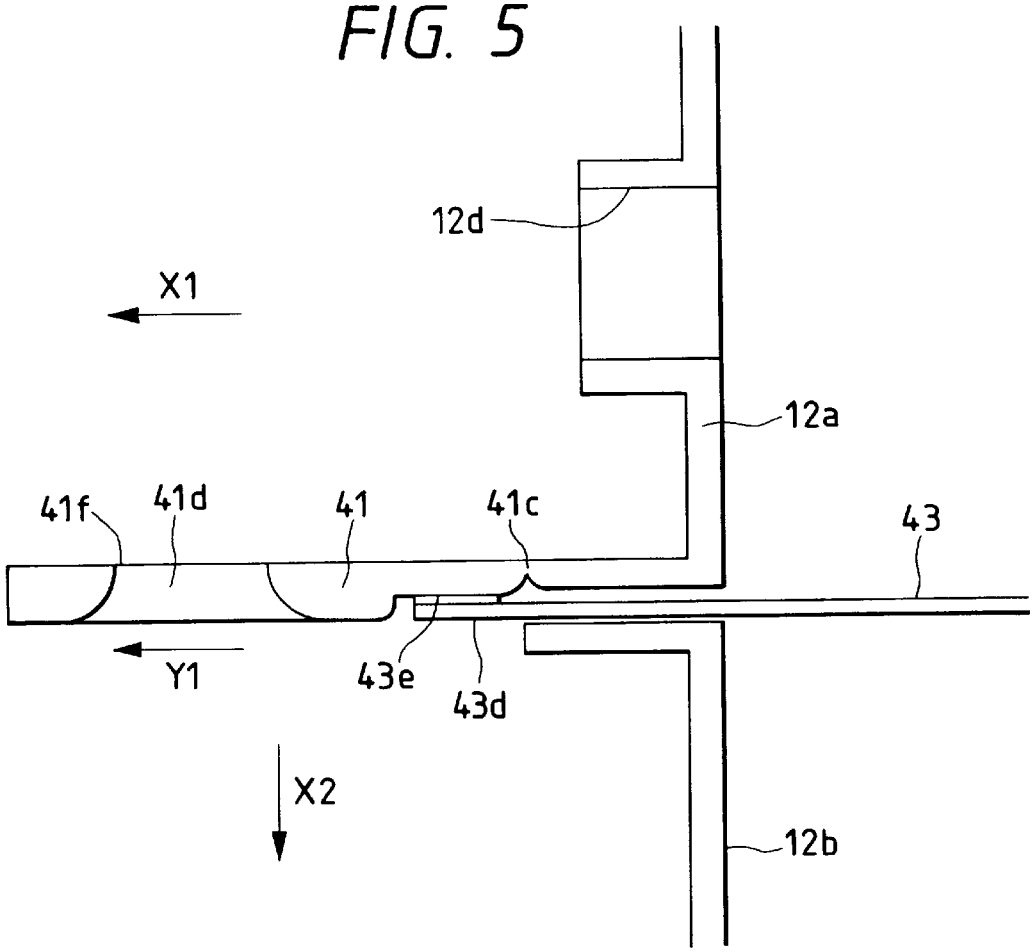
FIG. 5 is a sectional view of a toner seal pulling portion of the process cartridge of the present invention.

Now, the construction of the grip of the toner seal member will be fully described based on FIG. 5, which is a sectional view schematically showing the grip portion of the toner seal of the process cartridge according to the present invention.

Figure 6:
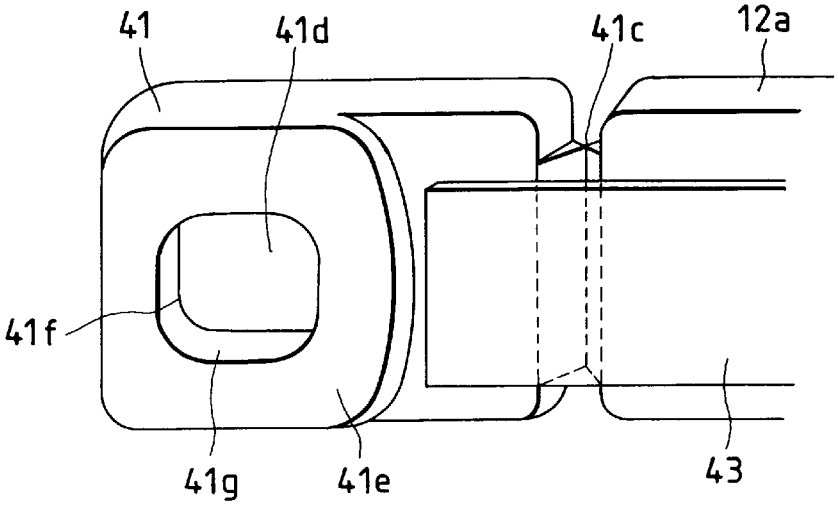
FIG. 6 is a perspective view of a toner seal pulling grip integral with a toner container.

To send the toner from the toner frame 12*a* to the developing frame 12*b*, it is necessary to pull the tear tape 43 in a direction shown by the arrow Y1 to unseal the toner seal. The end 43*d* of the tear tape 43 is secured to the grip 41 by a securing means 43*e* such as a double-sided adhesive tape, hot melt welding, and the like, and a weak line 41*c*, which permits easy separation of the grip from the toner frame, is formed in the grip 41 integrally formed with the toner frame 12*a*. By separating the grip 41 from the toner frame along the weak line 41*c* and by pulling the tear tape 43 via the grip 41, the cover film 42 can be torn or opened. As shown in FIG. 6, a hole 41*d* is formed in the grip 41. A peripheral portion around the hole 41*d* is thickened to prevent the deformation thereof when the grip 41 is bent along the weak line.

With the arrangement as mentioned above, since the grip 41 is integrally formed with the toner frame 12*a*, the molding cost and part control cost can be reduced. In addition, in spite of the conventional solid grips, when a great process cartridge of the A3 type, (Japanese Industrial Standard) in which a long toner tape comprised of a cover film 42 and a tear tape 43 must be pulled for a long distance, is used, the tear tape can be pulled while inserting the operator's finger into the hole of the grip due to ring shape of the grip. Thus the operability is improved.

[Second Embodiment]

Although the toner loading opening 12*d* must be formed in the right outer side surface (front or rear surface in FIG. 1) of the process cartridge B to load the toner efficiently, the toner loading opening 12*d* is provided in the front surface, as shown in FIG. 5. This is because a drive system 16 (FIG. 2), such as a gear train for transmitting a driving force to the toner feed member 10*b*2 for agitating the toner in the toner frame 12*a*, is provided on the rear surface.

Figure 1:
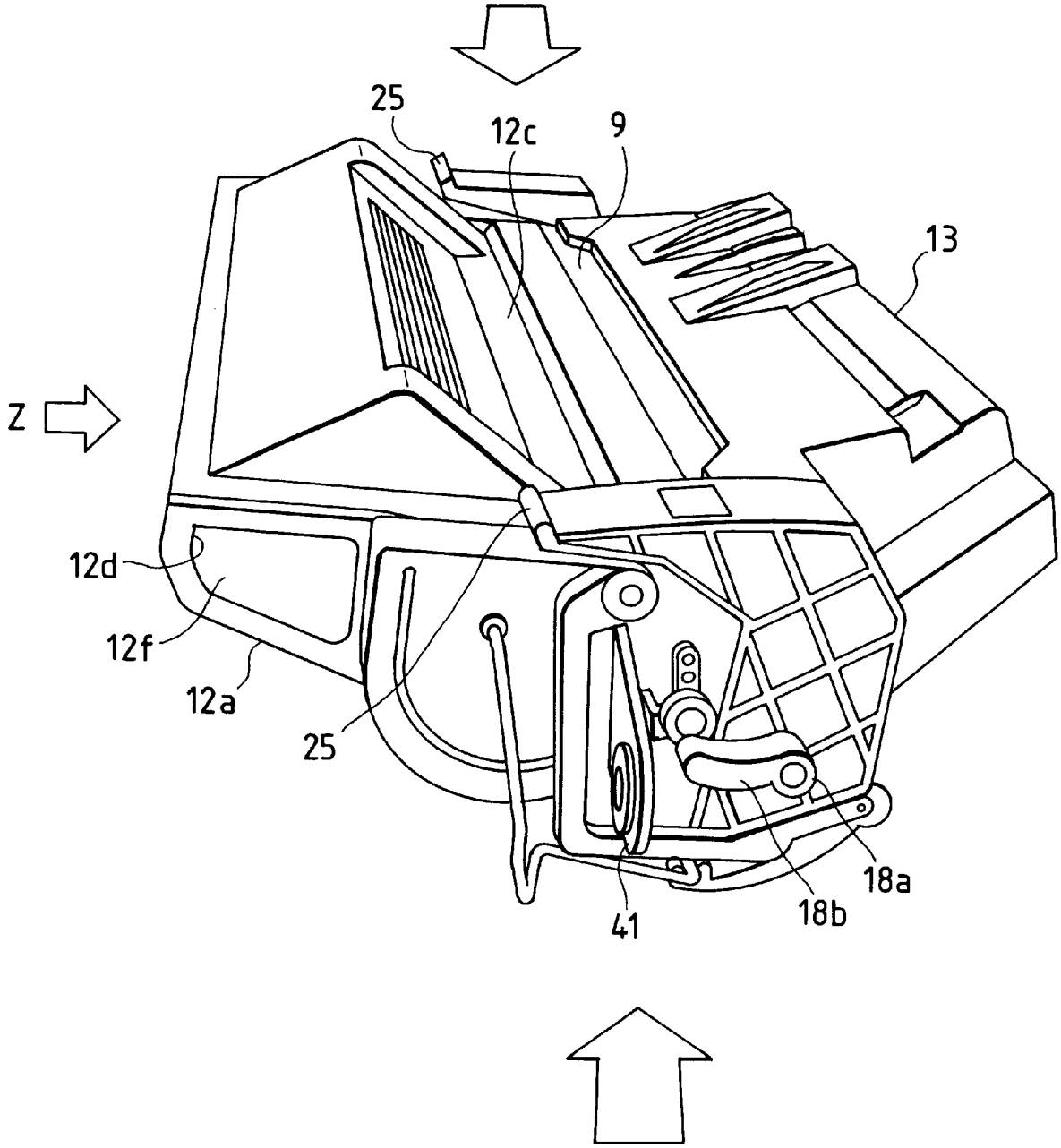
FIG. 1 is a perspective view of a process cartridge according to an embodiment of the present invention, showing a right outer side thereof.
Figure 2:
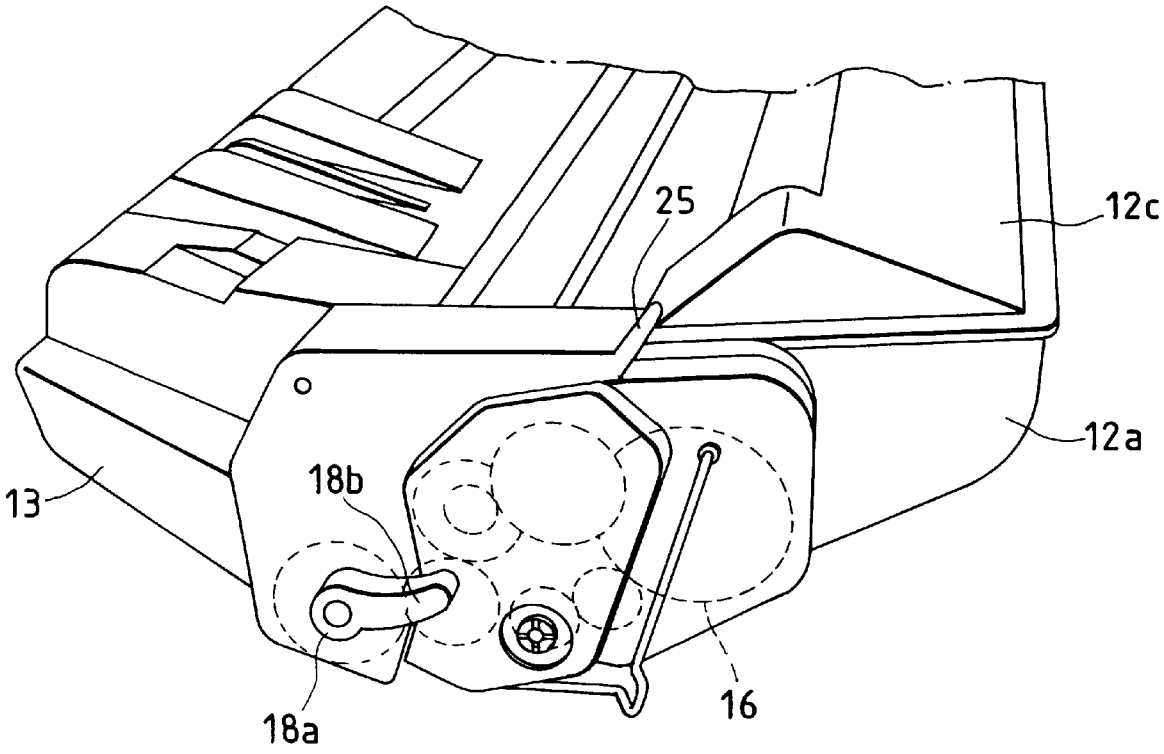
FIG. 2 is an enlarged partial perspective view of a process cartridge, showing a left outer side thereof.

Similarly, the grip 41 is also formed on the front surface in FIG. 1. Accordingly, when the grip 41 is formed integrally with the toner frame 12*a*, the removal direction of a mold for molding the toner frame 12*a* is limited to the direction shown by the arrow X1 in FIG. 5. Thus, after the molding, since "edges" are formed on upper side lines 41*f* (near the toner loading opening 12*d*) of an inner peripheral surface 41*g* of the hole 41*d* shown in FIG. 6, such edges are removed by heat-melting or barrel-grinding.

By performing such secondary working, the operator's finger can easily be inserted into the hole 41*d* of the grip and the toner seal can be pulled smoothly.

[Third Embodiment]

Figure 7:
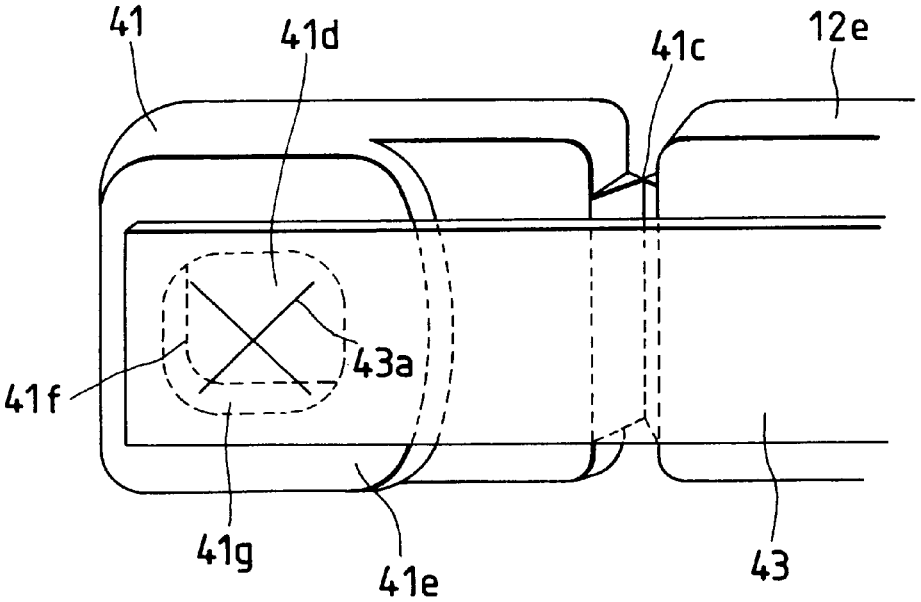
FIG. 7 is a perspective view of a grip whose outer edge portion overlaps a toner seal having cut lines.
Figure 8:
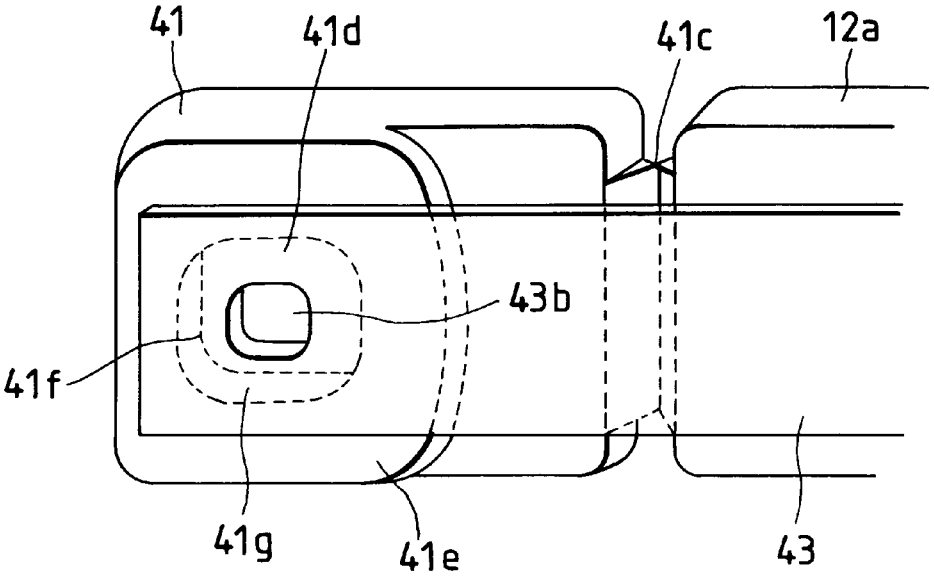
FIG. 8 is a perspective view of a grip whose outer edge portion overlaps a toner seal having a hole.

In order to eliminate the secondary working in the second embodiment, as shown in FIG. 7, the tear tape 43 of the toner seal is overlapped with the peripheral portion 41*e* of the hole of the grip 41 to be secured to the peripheral portion 41*e* by a double-sided adhesive tape or heat welding. Further, cut lines 43*a* are formed in a portion of the tear tape corresponding to the hole, or a hole 43*b* is formed on such a portion of the tear tape, as shown in FIG. 8.

Figure 9:
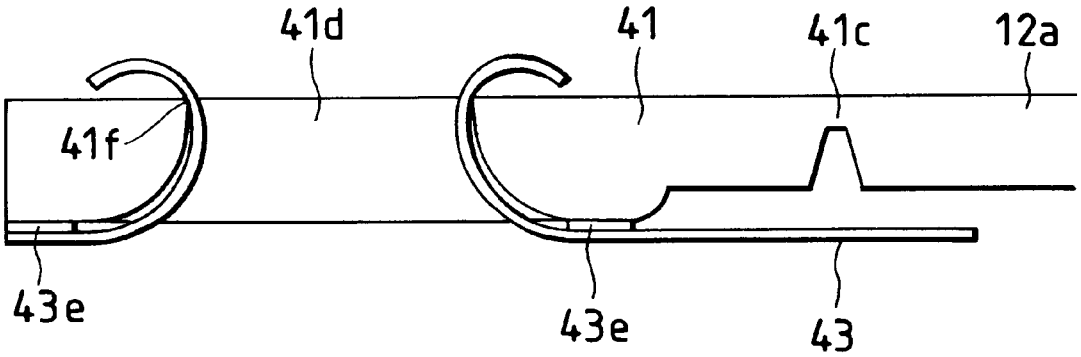
FIG. 9 is a sectional view showing the toner seal covering the edges of the grip hole.

With this arrangement, when the operator's finger is inserted into the hole 41*d* of the grip to pull the tear tape, as shown in FIG. 9, the tear tape 43 of the toner seal covers the edges on the upper side lines 41*f* of the inner peripheral surface 41*g* of the hole. In this case, since the tear tape 43 of the toner seal is positioned between the operator's inserted finger and the edges on the upper side lines 41*f* of the inner peripheral surface 41*g* of the hole as a buffer member, the toner seal pulling operation can be performed smoothly.

[Fourth Embodiment]

Figure 10:
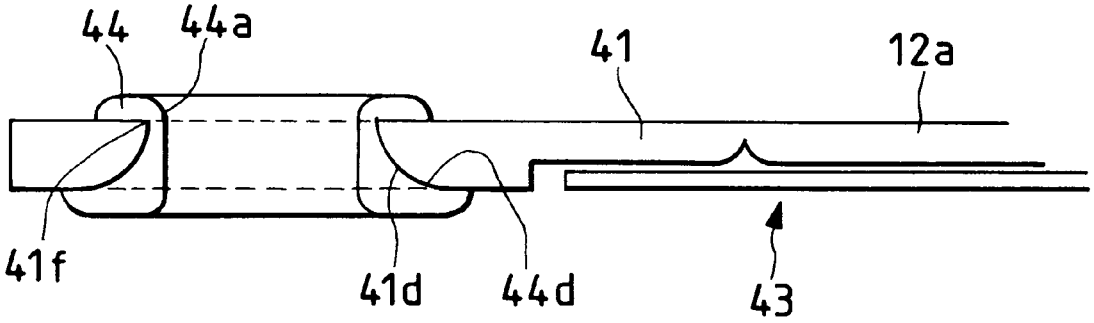
FIG. 10 is a sectional view of a grip in which a ring-shaped protection member is attached to the grip hole.

FIG. 10 shows an embodiment in which a ring-shaped protection member 44, having a curved surface, is attached to the inner peripheral surface of the hole 41*d* of the toner seal pulling grip 41. The protection member 44 is provided at its outer peripheral surface with a groove 44*d* for fitting onto the inner peripheral surface of the hole 41*d*. In order to attach the protection member into the hole, the ring-shaped protection member 44 is made of elastic material such a rubber and the protection member is fitted into the hole 41*d* while elastically deforming the protection member or a flange is formed on one end of the ring-shaped protection member, and the protection member is fitted into the hole 41*d* abutting the flange against the grip 41, and the flange is secured to the grip by adhesive or heat welding.

With this arrangement, the protection member can prevent the operator's finger from directly contacting the edges on the upper side lines 41*f* of the inner peripheral surface of the hole of the ring-shaped grip 41 (the edges are generated by limiting the removal direction of the mold for molding the toner frame including the toner loading opening 12*d* to the direction V1 in FIG. 5). Since the protection member 44 has the curved surface 44*a*, the operator's finger can easily be inserted into the protection member and the toner seal pulling operation can be performed smoothly.

Further, it is not necessarily to form the protection member from the same material as the toner frame 12*a*. Thus, when the protection member is made of material having a soft feeling, friction between the operator's finger and the protection member can be lessened.

[Fifth Embodiment]

Figure 11:
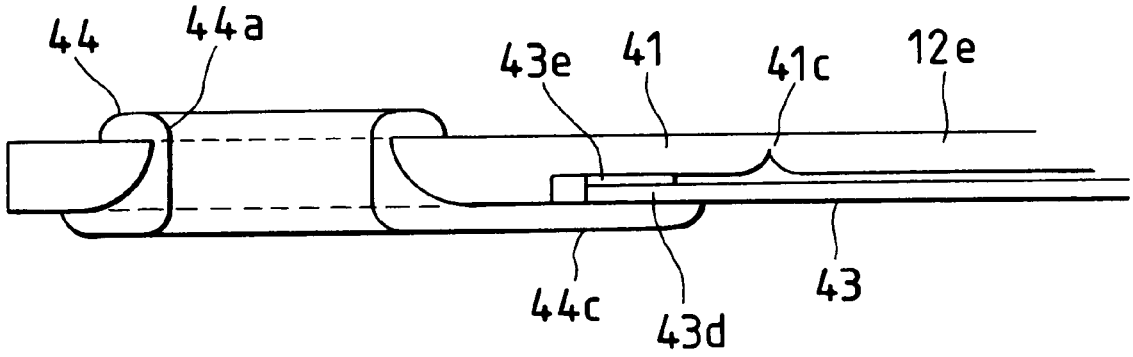
FIG. 11 is a sectional view of a grip in which the toner seal is pinched between the protection member and the grip.

As shown in FIG. 11, the tear tape 43 is secured to the grip 41 by pinching the end portion 43*d* of the tear tape 43 of the toner seal between a flange 44*c*, formed on the protection member 44, and grip 41. With this arrangement, there is less danger of detaching the tear tape 43 from the grip 41.

[Sixth Embodiment]

Figure 12:
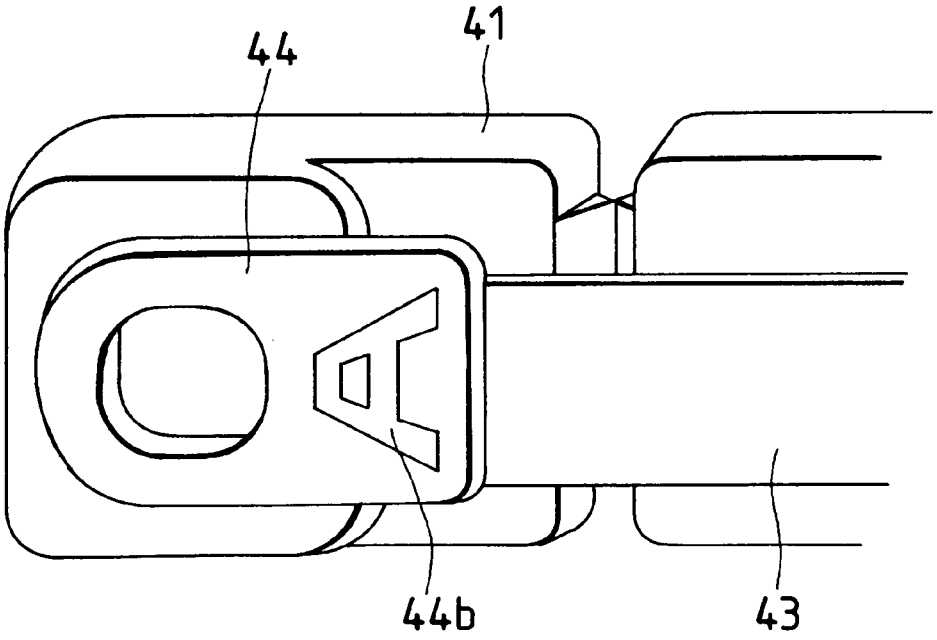
FIG. 12 is a perspective view of a protection member having a mark for displaying the contents of a process cartridge.

FIG. 12 shows an embodiment in which a mark 44*b* for distinguishing the process cartridge is formed on the protection member 44. The mark may be a character 44*b* or color painting. With this arrangement, the operator can easily recognize the contents in the process cartridge and the proper process cartridge can be used. Further, in the assembling line, when the protection member 44 is lastly assembled, even if any error (such as a recognition error regarding the contents in the process cartridge) occurs, the protection member 44 may be merely changed to a correct one, thereby providing a benefit in the assembling line.

(Other Embodiments)

Figure 17A:
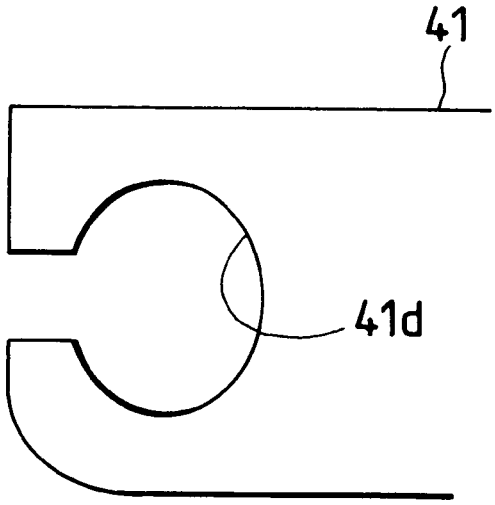
FIGS. 17A and 17B are side views showing a grip according to other embodiments
Figure 17B:
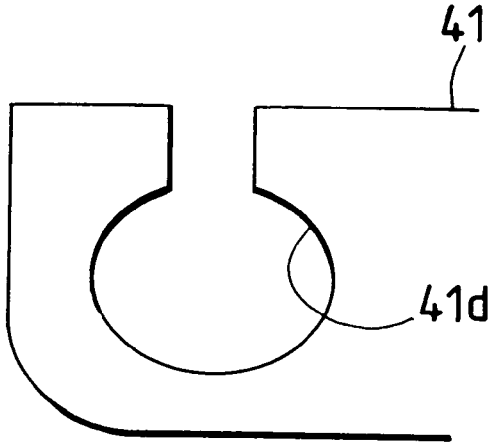

Next, other embodiments regarding the process cartridge B, the grip and the image forming apparatus will be described. While an example of the hole formed in the grip was explained, as shown in FIGS. 17A and 17B, the hole 41*d* of the grip may be opened to outside of the grip so long as the operator's finger can be inserted into the hole.

In the above-mentioned embodiments, while an example of the grip formed integrally with the toner frame was explained, the grip may be formed integrally with the developing frame. That is to say, the grip may be formed integrally with any one of frames of the developing unit.

While the process cartridge was used for forming a mono-color image, the present invention can be applied to a process cartridge in which a plurality of developing means, containing different color toners, are provided to form a plural color image (for example, a two-color image, a three-color image or a full-color image). The developing means can utilize a conventional two-component magnetic brush developing method, a conventional cascade developing method, a conventional touch-down developing method, a conventional cloud developing method, or the like.

The electrophotographic photosensitive member is not limited to the photosensitive drum. For example, a photosensitive body may be a photo-conductive body. The photoconductive body may be composed of amorphous silicone, amorphous selenium, zinc oxide, titanium oxide or an organic photo-conductor. The photosensitive body may be mounted on a belt-shaped or sheet-shaped rotary member, as well as the drum. In general, the drum or the belt-shaped rotary member is used. For example, in the photosensitive drum, the photo-conductive body is formed on an aluminum cylinder by deposition or coating.

While the first embodiment uses a charge means of the so-called contact-charging type, other conventional charge means, in which tungsten wires are enclosed by metallic shields made of aluminum at three side thereof and positive or negative ions generated by applying high voltage to the tungsten wires are shifted to the surface of the photosensitive drum to uniformly charge the surface of the photosensitive drum, may be used.

The charge means is not limited to a charge roller but may be of a blade-(charging blade) type, a pad type, a block type, a rod type, or a wire type. The cleaning means for removing the residual toner from the photosensitive drum is not limited to a cleaning blade, but may include a fur brush, a magnetic brush, or the like.

The process cartridge includes the electrophotographic photosensitive member and the developing means, and at least one process means. Accordingly, the process cartridge is not limited to the illustrated one, but may include the electrophotographic photosensitive member, the developing means, and the charge means as a unit, which can removably be mounted on the image forming apparatus. It may also include the electrophotographic photosensitive member, the developing means as a unit, which can removably be mounted on the image forming apparatus, or may include the electrophotographic photosensitive member, the developing means, and the cleaning means as a unit, which can removably be mounted on the image forming apparatus.

That is to say, the process cartridge incorporates therein the electrophotographic photosensitive member, the developing means, and the charge means, or the cleaning means as a unit, which can removably be mounted on the image forming apparatus. It also incorporates therein the electrophotographic photosensitive member and the developing means, and at least one of the charge means and the cleaning means as a unit, which can removably be mounted on the image forming apparatus, or incorporates therein the electrophotographic photosensitive member and the developing means as a unit which can removably be mounted on the image forming apparatus.

While the illustrated embodiments embody the image forming apparatus as a laser beam printer, the present invention is not limited to the laser beam printer, but can be applied to an electrophotographic copying machine, an electrophotographic facsimile, an electrophotographic word processor, and the like.

As mentioned above according to the above-mentioned embodiments, the following advantages can be obtained:

(1) Since the grip for pulling the developer seal member is formed integrally with the frame of the developing unit, a "cost-down" can be achieved. In spite of conventional grips of the solid type in which the developer seal member is pulled while the operator grips the grip, when a great process cartridge of the A3 type (Japanese Industrial Standard), in which a developer seal member tape must be pulled for a long distance, is used, the seal member can be pulled stably while inserting the operator's finger into the hole of the grip due to ring shape of the grip. Thus, operability is improved.

(2) Since the edges on the upper side lines of the inner peripheral surface of the hole of the ring-shaped grip (the edges are generated by limiting the removal direction of the mold for molding the toner frame including the toner loading opening to one direction, because the developer seal member pulling grip is disposed near the toner loading opening) are removed by heat-melting or barrel-grinding, sharp corners do not exist.

(3) The developer seal member is overlapped with the peripheral portion of the hole of the developer seal member pulling grip and is secured to the peripheral portion by a double-sided adhesive tape or heat welding, and the cut lines are formed in a portion of the seal member corresponding to the hole or a hole is formed on such a portion of the tear tape. So, when the operator's finger is inserted into the hole of the grip, the seal member covers the edges on the upper side lines of the inner peripheral surface of the hole (the edges are generated by limiting the removal direction of the mold for molding the toner frame including the toner loading opening to one direction, because of the presence of the toner loading opening), with the result that the seal member pulling operation can be performed without directly contacting the edges.

(4) Since the ring-shaped protection member having the curved surface is attached to the inner peripheral surface of the hole of the developer seal member pulling grip, the protection member can prevent the operator's finger from directly contacting the edges on the upper side lines of the inner peripheral surface of the hole of the ring-shaped grip (the edges are generated by limiting the removal direction of the mold to one direction, because of the presence of the toner loading opening). Further, since the protection member has a curved inner surface, the operator's finger can easily be inserted into the protection member and the developer seal member pulling operation can be performed smoothly. Further, since it is not necessary to form the protection member from the same material as the developing unit, when the protection member is made of material having a soft feeling, friction between the operator's finger and the protection member can be lessened.

(5) Since the developer seal member is secured to the grip by pinching the developer seal member between the protection member and the grip, there is less danger of detaching the developer seal member from the grip, compared with the conventional case in which the developer seal member is merely secured to the grip by adhesive.

(6) Since the mark (character or color painting) for distinguishing the process cartridge is formed on the protection member, the operator can easily recognize the contents (for example, black toner, color toner or different toner) of the process cartridge and the proper process cartridge can be used regarding the image forming apparatus. Further, in the assembly line, since the protection member is lastly assembled, even if any error (such as recognition error regarding the contents in the process cartridge) occurs, the protection member may be merely changed to a correct one, thereby providing a benefit in the assembly line.

As mentioned above, according to the present invention, the operability for pulling the developer seal member can be improved.

What is claimed is:

1. A seal member for openably closing a toner supply opening of a toner container having a frame and containing toner to be used in an electrophotographic image forming apparatus, comprising:

a seal portion for openably closing said toner supply opening;

a grip provided at one end of said seal portion to be gripped when said toner supply opening is opened, and having a hole with an inner peripheral surface having edges;

a protection member for covering the edges of the inner peripheral surface of the hole of said grip; and an attachment portion for detachably attaching said grip to said frame of the toner container.

2. A seal member according to claim 1, wherein said frame to which said grip is attached is provided with a toner loading opening through which toner is supplied to said toner container, and wherein said protection member covers an edge of the inner peripheral surface of the hole of said grip near said toner loading opening.

3. A seal member according to claim 1 or 2, wherein said protection member has a recognizing mark.

4. A seal member according to claim 1 or 2, wherein said protection member is colored for recognition.

5. A seal member according to claim 1 or 2, wherein said protection member has a shape cover an end portion of the seal member.

6. A seal member according to claim 1 or 2, wherein said protection member constitutes a part of the seal member.

7. A seal member according to claim 1, wherein the edges of the inner peripheral surface of the hole are melting-deformation edges which are the product of melting deformation.

8. A seal member according to claim 1, wherein the edges of the inner peripheral surface of the hole are grinding edges which are the product of grinding.

9. A seal member according to claim 1, 2, 7 or 8, wherein said seal portion is flexible and said grip is rigid.

10. A seal member according to claim 1, wherein said protection member is substantially ring-shaped and comprises an inner peripheral surface having a curved shape and a groove on its outer peripheral surface for fitting onto the inner peripheral surface of the hole of said grip, wherein said grip is formed integral with said frame at said attachment portion, and wherein said attachment portion includes a weak line having a width and thickness less than that of said grip and said frame.

11. A process cartridge detachably mountable to an electrophotographic image forming apparatus, comprising:

a cartridge frame;

an electrophotographic photosensitive member;

a developing member for developing a latent image formed on said electrophotographic photosensitive member;

a toner containing portion for containing toner to be used in development by said developing member, said toner containing portion having a toner supply opening for supplying toner to said developing member; and a seal member for openably closing said toner supply opening, said seal member including a seal portion for openably closing said toner supply opening, a grip provided at one end of said seal portion to be gripped when said toner supply opening is opened, and having a hole with an inner peripheral surface having edges, a protection member for covering the edges of the inner peripheral surface of the hole of said grip, and an attachment portion for detachably attaching said grip to said cartridge frame, wherein said grip is detachably attached to said cartridge frame by said attachment portion.

12. A process cartridge according to claim 11, wherein said frame to which said grip is attached is provided with a toner loading opening through which toner is supplied to said toner container, and wherein said protection member covers an edge of the inner peripheral surface of the hole of said grip near said toner loading opening.

13. A process cartridge according to claim 11 or 12, wherein said protection member has a recognizing mark.

14. A process cartridge according to claim 11 or 12, wherein said protection member is colored for recognition.

15. A process cartridge according to claim 11 or 12, wherein said protection member has a shape covering an end portion of the seal member.

16. A process cartridge according to claim 11 or 12, wherein said protection member constitutes a part of the seal member.

17. A process cartridge according to claim 11, wherein the edges of the inner peripheral surface of the hole are melting-deformation edges which are the product of melting deformation.

18. A process cartridge according to claim 11, wherein the edges of the inner peripheral surface are grinding edges which are the produce of.

19. A process cartridge according to claim 11, 12, 17 or 18, wherein said seal portion is flexible and said grip is rigid.

20. A process cartridge according to claim 11, further comprising charge means for charging said electrophotographic photosensitive member.

21. A process cartridge according to claim 11, further comprising cleaning means for removing the residual toner remaining on said electrophotographic photosensitive member.

22. A process cartridge according to claim 11, wherein said protection member is substantially ring-shaped and comprises an inner peripheral surface having a curved shape and a groove on its outer peripheral surface for fitting onto the inner peripheral surface of the hole of said grip, wherein said grip is formed integral with said frame at said attachment portion, and wherein said attachment portion includes a weak line having a width and thickness less than that of said grip and said frame.

23. A toner container for containing toner to be used in an image forming apparatus, comprising:

a toner container frame;

a toner containing portion for containing toner;

a toner supply opening for supplying toner contained in said toner containing portion;

a seal portion for openably closing said toner supply opening;

a grip provided at one end of said seal portion, adapted to be gripped when said toner supply opening is unsealed, and having a hole with an inner peripheral surface having edges;

a protection member for covering the edges of the inner peripheral surface of the hole of said grip; and;

an attachment portion for detachably attaching said grip to said toner container frame.

24. A toner container according to claim 23, wherein said frame to which said grip is attached is provided with a toner loading opening through which toner is supplied to said toner container, and wherein said protection member covers an edge of the inner peripheral surface of said hole of said grip near said toner loading opening.

25. A toner container according to claim 23 or 24, wherein said protection member has a recognizing mark.

26. A toner container according to claim 23 or 24, wherein said protection member is colored for recognition.

27. A toner container according to claim 24, wherein said protection member has a shape cover an end portion of the seal member.

28. A toner container according to claim 24, wherein said protection member constitutes a part of the seal member.

29. A toner container according to claim 23, wherein the edges of the inner peripheral surface of the hole are melting-deformation edges which are the product of melting deformation.

30. A toner container according to claim 23, wherein the edges of the inner peripheral surface of the hole are grinding edges which are the product of grinding.

31. A toner container according to claim 23, 24, 29 or 30, wherein said seal portion is flexible and said grip is rigid.

32. A toner container according to claim 23, wherein said protection member is substantially ring-shaped and comprises an inner peripheral surface having a curved shape and a groove on its outer peripheral surface for fitting onto the inner peripheral surface of the hole of said grip, wherein said grip is formed integral with said frame at said attachment portion, and wherein said attachment portion includes a weak line having a width and thickness less than that of said grip and said frame.

33. A seal member for openably closing a toner supply opening of a toner container containing toner to be used in an electrophotographic image forming apparatus, comprising:

a seal portion for openably closing said toner supply opening; and a grip provided at one end of said seal portion and having a hole to be gripped by an operator when the toner supply opening is opened, said grip being formed integral with a resin frame of said toner container and is separated from said frame by folding along a connected portion connecting said grip and said frame.

34. A seal member according to claim 33, wherein said frame is provided with a toner loading opening through which toner is supplied to said toner container, and wherein said seal member further comprises a protection member covering an edge of an inner peripheral surface of the hole of said grip near said toner loading opening.

35. A seal member according to claim 34, wherein said protection member includes a recognition mark.

36. A seal member according to claim 34 or 35, wherein said protection member is colored for recognition.

37. A seal member according to claim 34 or 35, wherein said protection member has a shape to cover an end portion of the seal member.

38. A seal member according to claim 34 or 35, wherein said protection member constitutes part of the seal member.

39. A seal member according to claim 33, wherein the hole of said grip includes an inner peripheral surface with edges that are melting-deformation edges which are the produce of melting deformation.

40. A seal member according to claim 33, wherein the hole of said grip includes an inner peripheral surface with edges that are grinding edges which are the product of grinding.

41. A seal member according to claim 33, 34, 39 or 40, wherein said seal portion is flexible and said grip is rigid.

42. A seal member according to claim 33, wherein said grip comprises an inner peripheral surface having a curved shape, wherein a peripheral portion of said grip around the hole is thickened, and wherein said connected portion includes a weak line having a width and thickness less than that of said grip and said frame.

43. A process cartridge detachably mountable to an electrophotographic image forming apparatus, comprising:

an electrophotographic photosensitive member;

a developing member for developing a latent image formed on said electrophotographic photosensitive member;

a toner containing portion for containing toner to be used in development by said developing member, said toner containing portion having a resin toner container frame and having a toner supply opening for supplying toner to said developing member; and a seal member for openably closing said toner supply opening, said seal member including a seal portion for openably closing said toner supply opening, and a grip provided at one end of said seal portion and having a hole to be gripped by an operator when the toner supply opening is opened, said grip being formed integral with said resin toner container frame and is separated from said frame by folding along a connected portion connecting said grip and said frame.

44. A process cartridge according to claim 43, wherein said toner frame is provided with a toner loading opening through which toner is supplied to said toner container, and wherein said process cartridge further comprises a protection member covering an edge of an inner peripheral surface of the hole of said grip near said toner loading opening.

45. A process cartridge according to claim 44, wherein said protection member includes a recognition mark.

46. A process cartridge according to claim 44 or 45, wherein said protection member is colored for recognition.

47. A process cartridge according to claim 44 or 45, wherein said protection member has a shape to cover an end portion of the seal member.

48. A process cartridge according to claim 44 or 45, wherein said protection member constitutes part of the seal member.

49. A process cartridge according to claim 43, wherein the hole of said grip includes an inner peripheral surface having edges that are melting-deformation edges which are the produce of melting deformation.

50. A process cartridge according to claim 43, wherein the hole of said grip includes an inner peripheral surface having edges that are grinding edges which are the product of grinding.

51. A process cartridge according to claim 43, 44, 49 or 50, wherein said seal portion is flexible and said grip is rigid.

52. A process cartridge according to claim 43, wherein said grip comprises an inner peripheral surface having a curved shape, wherein a peripheral portion of said grip around the hole is thickened, and wherein said connected portion includes a weak line having a width and thickness less than that of said grip and said frame.

53. A toner container for containing toner to be used in an image forming apparatus, comprising:

a toner containing portion for containing toner;

a resin toner container frame;

a toner supply opening for supplying toner contained in said toner containing portion;

a seal portion for openably closing said toner supply opening; and a grip provided at one end of said seal portion and having a hole to be gripped by an operator when the toner supply opening is opened, said grip being formed integral with said resin toner container frame and is separated from said frame by folding along a connected portion connecting said grip and said frame.

54. A toner container according to claim 53, wherein said resin toner container frame is provided with a toner loading opening through which toner is supplied to said toner container, and wherein said container further comprises a protection member covering an edge of an inner peripheral surface of the hole of said grip near said toner loading opening.

55. A toner container according to claim 54, wherein said protection member includes a recognition mark.

56. A toner container according to claim 54 or 55, wherein said protection member is colored for recognition.

57. A toner container according to claim 54 or 55, wherein said protection member has a shape to cover an end portion of the seal member.

58. A toner container according to claim 54 or 55, wherein said protection member constitutes part of the seal member.

59. A toner container according to claim 53, wherein the hole of said grip includes an inner peripheral surface having edges that are melting-deformation edges which are the product of melting deformation.

60. A toner container according to claim 53, wherein the hole of said grip includes an inner peripheral surface having edges that are grinding edges which are the product of grinding.

61. A seal member according to claim 53, 54, 59 or 60, wherein said seal portion is flexible and said grip is rigid.

62. A toner container according to claim 53, wherein said grip comprises an inner peripheral surface having a curved shape, wherein a peripheral portion of said grip around the hole is thickened, and wherein said connected portion includes a weak line having a width and thickness less than that of said grip and said frame.

* * * * *

UNITED STATES PATENT AND TRADEMARK OFFICE

CERTIFICATE OF CORRECTION

PATENT NO. : 5,937,237

DATED : August 10, 1999

INVENTOR(S) : FUMITO NONAKA, ET AL.

It is certified that error appears in the above-identified patent and that said Letters Patent is hereby corrected as shown below:

COLUMN 1

Line 9, "is" should be deleted.

COLUMN 2

Line 40, "embodiments" should read --embodiments.--.

COLUMN 3

Line 40, "the; optical " should read --The optical--.

Line 45, "container." should read --container,--.

COLUMN 7

Line 54, "necessarily" should read --necessary-- .

COLUMN 10

Line 52, "cover" should read --to cover--.

COLUMN 11

Line 55, "produce of." should read --product of grinding--.

UNITED STATES PATENT AND TRADEMARK OFFICE

CERTIFICATE OF CORRECTION

PATENT NO. : 5,937,237

DATED : August 10, 1999

INVENTOR(S) : FUMITO NONAKA, ET AL.

It is certified that error appears in the above-identified patent and that said Letters Patent is hereby corrected as shown below:

COLUMN 12

Line 37, "cover" should read --to cover--.

COLUMN 13

Line 24, "produce" should read --product--.

Signed and Sealed this

Sixth Day of June, 2000

*Attest:*

*Attesting Officer*

Q. TODD DICKINSON

*Director of Patents and Trademarks*